US005419308A

United States Patent [19]

Lee

[11] Patent Number: 5,419,308

[45] Date of Patent: May 30, 1995

[54] GAS-USING WATER HEATER HAVING A WATER PRESSURE-CONTROLLED GAS GENERAL SWITCH

[76] Inventor: Chia Lee, No. 5, Alley 5, Lane 105, Chung-Cheng Rd., Sec. 3, Tu-Cheng City, Taipei, Taiwan, Prov. of China

[21] Appl. No.: 103,232

[22] Filed: Aug. 9, 1993

[51] Int. Cl.[6] ..... A47J 27/00

[52] U.S. Cl. ..... 126/374; 126/344; 126/351; 126/350 D; 4/603

[58] Field of Search ..... 126/374, 344, 348, 367, 126/376, 388, 351, 350 D, 210; 237/8 D, 2 A, 63, 65; 4/603; 137/337

[56] References Cited

U.S. PATENT DOCUMENTS

| | | | |
|---|---|---|---|
| 4,508,261 | 4/1985 | Blank | 126/374 X |
| 5,143,050 | 9/1992 | Spivey | 126/374 |
| 5,205,318 | 4/1993 | Massaro et al. | 137/337 |
| 5,206,963 | 5/1993 | Wiens | 4/603 |

*Primary Examiner*—Larry Jones

*Attorney, Agent, or Firm*—Bacon & Thomas

[57] ABSTRACT a gas-using water heater having a water pressure-controlled gas general switch, wherein the water pressure-controlled gas general switch is disposed outside the water heater and is combined with the original manually operated gas general switch to form a dual general switch and with respect to a site provided with low water pressure, the water heater is additionally equipped with a pressurizing motor pump, fuses being disposed inside and outside the water heater, whereby when consuming the hot water, the movement of the water flow can activate an electric controlling system and a water guiding tube, making the water pressure-controlled gas general switch automatically cooperatively turn on/off the gas or turn on/off the pressurizing motor pump, and when the fuses burn down, the power is shut off, making the gas general switch automatically turn off the gas, so that the leak of gas can hardly take place and the user provided with low water pressure can obtain greater water pressure and in case of a fire, the gas can be turned off in time.

5 Claims, 20 Drawing Sheets

GAS-USING WATER HEATER HAVING A WATER PRESSURE-CONTROLLED GAS GENERAL SWITCH

BACKGROUND OF THE INVENTION

The present invention relates to a gas-using water heater having a water pressure-controlled gas general switch, wherein the water pressure-controlled gas general switch is disposed outside the water heater and is combined with the original manually operated gas general switch to form a dual general switch.

A conventional gas-using water heater more or less has the problem of gas leakage, especially after a long period use of the water heater or when the water heater is improperly used. The gas leakage of the water heater will cause the waste of gas or even cause disaster.

Moreover, a conventional gas-using water heater is provided with only one manually operated gas switch located on a gas tube or a head portion of a gas container. A user is likely to forget to close such manually operated gas switch or not to desire to close the same.

Accordingly, a potential danger exists when using the conventional gas-using water heater.

In addition, in case the water heater is installed at a very high position such as a top floor or other sites provided with low water pressure, especially when bathing with a sprinkler, the water flow with low water pressure often cannot meet the actual requirement of the gas-using water heater. The conventional gas-using water heater is not provided with a pressurizing motor pump so that respecting the low water pressure site, the user must add a pressurizing motor pump to the water heater for acquiring the necessary water pressure. Furthermore, the conventional gas-using water heater is not provided with any device capable of automatically closing the general gas switch in case of a fire so that when a fire takes place, the gas-using water heater is likely to aid the fire.

The conventional gas-using water heater mainly includes a water supplying/discharging system, an electric control system, a burning system and a heat exchanging system. All these systems are received in a housing. The water heater is connected with external gas tube and water pipe. The water temperature and amount can be adjusted by means of an adjusting switch disposed on the housing. Several portions of the above systems which relates to the present invention are described as follows:

1. The water supplying/discharging system:

Please refer to FIGS. 2, 13 and 14. A water supplying tube 20, a cold water discharging tube 37 and a hot water discharging tube 14 are disposed under the water heater. A Venturi controller 10 is disposed adjacent to the water supplying tube 20. The Venturi controller 10 is divided into an upper and a lower chambers which are communicated with each other by a small tube 69. An upper end of the small tube 69 is connected with the upper chamber while a lower end of the small tube 69 is connected with a Venturi tube 65. The upper and lower chambers are separated by a resilient partitioning board 74. The water is filled into the upper chamber through the small tube from the Venturi tube 65. The lower chamber is directly communicated with the water supplying tube 20. An aiding board 67 is disposed above the partitioning board 74 and a top needle 61 is connected above the aiding board 67 and extended through the Venturi controller 10 for pushing away a gas incoming main valve of the water heater. The main valve has a pressing key 34 extending outside the main valve for controlling an electric switch 35. Before the top needle 61 opens the main valve, a compression spring 52 and an airtight board 48 are used to seal the gas from flowing through the main valve. A water pipe-like pre-heater 21 and a heat exchanger 2 are disposed near a middle portion of the water heater.

The water enters the water heater through such a route that the water first flows through the Venturi controller 10 into the pre-heater 21 and then flows through the heat exchanger 2 to be discharged from the water discharging tube. The Venturi tube 65 can suck the water in the upper chamber so that after continuous suction, the amount of the water contained in the upper chamber is reduced and the water pressure thereof is lowered. In contrast with the upper chamber, the lower chamber is communicated with the water supplying tube and therefore the water pressure of the lower chamber is kept constant. As a result, the water pressure of the lower chamber is larger than that of the upper chamber and the resilient partitioning board 68 is pressed by the water in the lower chamber and bent upward, making the aiding board 67 and the top needle 61 pushed upward.

When the water is not further supplied, the Venturi tube 65 is free from water flow and loses the sucking ability. Therefore, the lower chamber reversely fills the water into the upper chamber through the small tube 69. After the upper chamber is filled up with water, the water pressure in the upper and lower chambers becomes balanced and the partitioning board 68 is released from pressing force and lowered to the original position. Meanwhile, the compression spring 52 urges the aiding board 67 and the top needle 61 to descend to their original position.

2. Electric control system:

A 1.5 V cell is disposed in a cell box located under the water heater. A sensing electronic transformer 8 is connected with the cell box for increasing the 1.5 V input voltage to 12 KV output voltage. After the cell is connected, two spark needles of a positive and a negative electrodes of the sensing electronic transformer create spark to burn the gas.

An electric switch 35 is disposed above the Venturi controller 10 and controlled by the pressing key 34. When the pressing key 34 ascends, the electric switch 35 connects with the power source, while when the pressing key 34 descends, the power is cut off. When the power is connected, the cell continuously supplies power to the transformer 8, making the spark needles continuously spark. When the gas of a pilot burner 22 is burned, the transformer 8 creates singles to stop the spark needle from sparking.

3. The burning system:

The burning system includes a gas incoming main valve, a gas incoming subsidiary valve 26, a pilot burner 22, a gas injecting tube 6, a gas sleeve 28, a gas nozzle 72, a main oven 5, a gas cock 9 and a smoke-discharging funnel 15. When the top needle 61 biases open the main valve, the gas flows thereinto from external tube and on one hand goes through the fine tube 27 toward the pilot burner and on the other hand goes through another fine tube 27 toward the electromagnetic gas valve 60 and gas incoming subsidiary valve 26 to be discharged from the gas injecting tube 6. At this time, small amount of gas exists at the openings of the pilot burner and gas injecting tube 6 and a spark can ignite the gas.

The Venturi controller first makes the main valve open, permitting the gas to flow into the pilot burner 22 and gas injecting tube 6 from the external tube. However, due to the delay effect, the electric switch 35 is not connected with the power source for creating the sparks. Therefore, the gas incoming subsidiary valve 26 is also under the pressure of the gas which is accumulated on the surface of a resilient separating board 74, making the same bent rearward. A link rod fitted with a pulling spring is disposed on the separating board 74. An airtight board 71 is disposed at a head portion of the link rod in alignment with a gas inlet. Therefore, when the separating board 74 is bent, the link rod and airtight board 71 are moved forward against the pulling force of the spring to seal the gas inlet and prevent the gas from passing therethrough. At this time, no gas is injected from the gas nozzle.

When the Venturi controller 10 continuously makes the top needle 61 ascend, the main valve is continuously opened, permitting the gas to continuously flow thereinto from the external tube. When the top needle 61 ascends to a preset height, the electric switch is released from the control of the pressing key 34 and connected with the power source. At this time, the electronic transformer 8 via the spark needle ignites the gas of the pilot burner. Meanwhile, the electromagnetic gas valve 60 is powered to seal the gas inlet of the fine tube so that the subsidiary valve 26 is not supplemented with new gas and released from the gas pressure and the pulling spring pulls the link rod and airtight board 71 away from the gas inlet, permitting the gas to flow through the main valve and gas cock 73 and enter the gas sleeve 25 from the subsidiary valve 26 and then enter the main oven from respective nozzles. At this time, the gas of the pilot burner 22 is ignited and the gas injected from the main oven is ignited. Also, the remaining gas in the gas injecting tube is ignited and burned. The smoke is discharged from the smoke discharging funnel.

DETAILED DESCRIPTION OF THE PREFERRED EMBODIMENT

The gas general switches of the present invention can be divided into two types one of which is used for natural gas and the other of which is used for the liquid gas. The latter is integrally manufactured with a gas pressure adjusting device 59 as shown in FIGS. 17A–17E.

As shown in FIGS. 2–4 and 9–12, the gas general switch is connected with a water pressure pipe 19 via a water guiding pipe and connectors 50, 56. The water pressure pipe is connected with a first and a second electromagnetic valves 42A, 42B and a gas general switch indicator 28.

Figure 1:
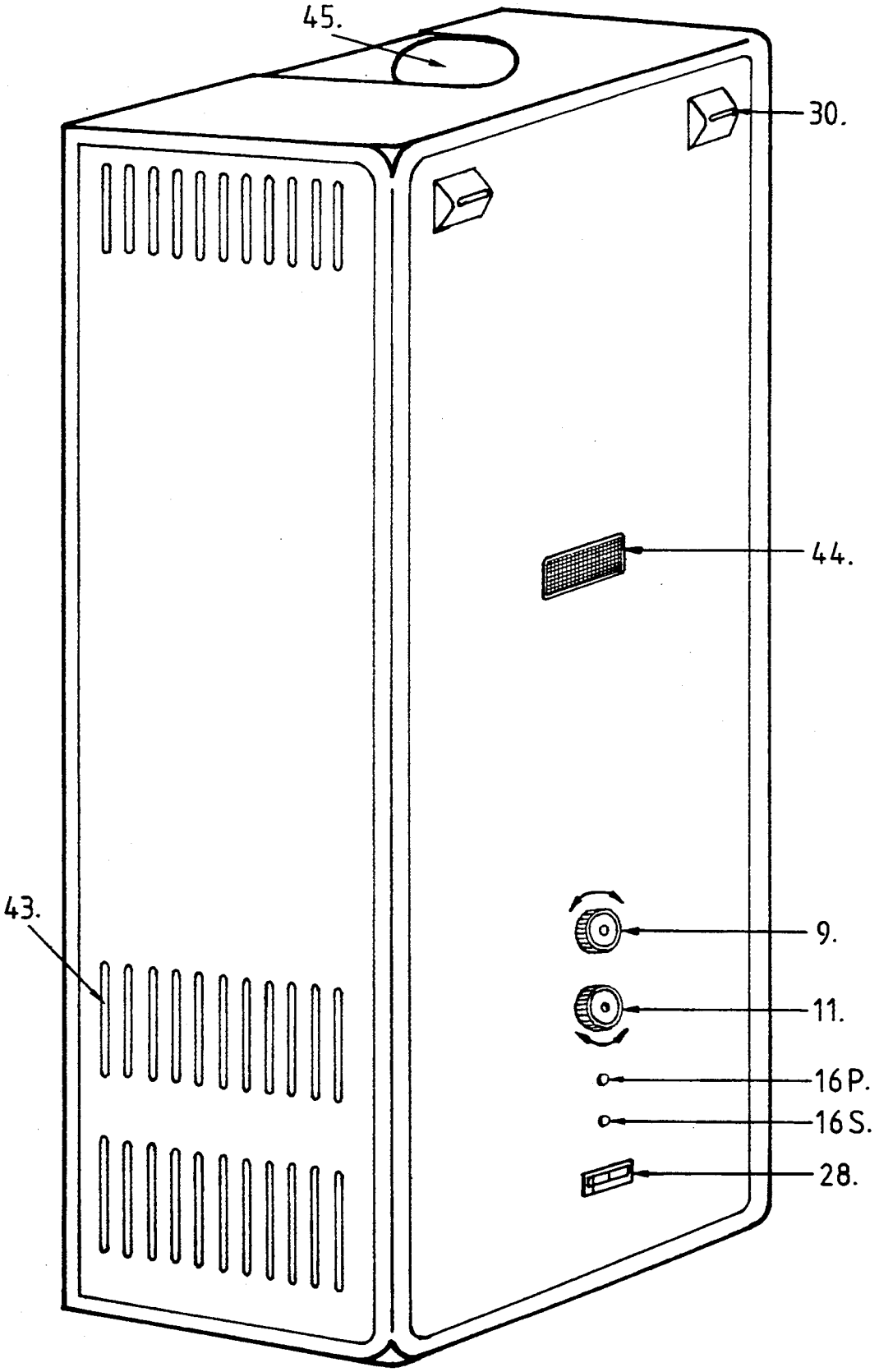
FIG. 1 is a perspective view of the present invention.
Figure 2:
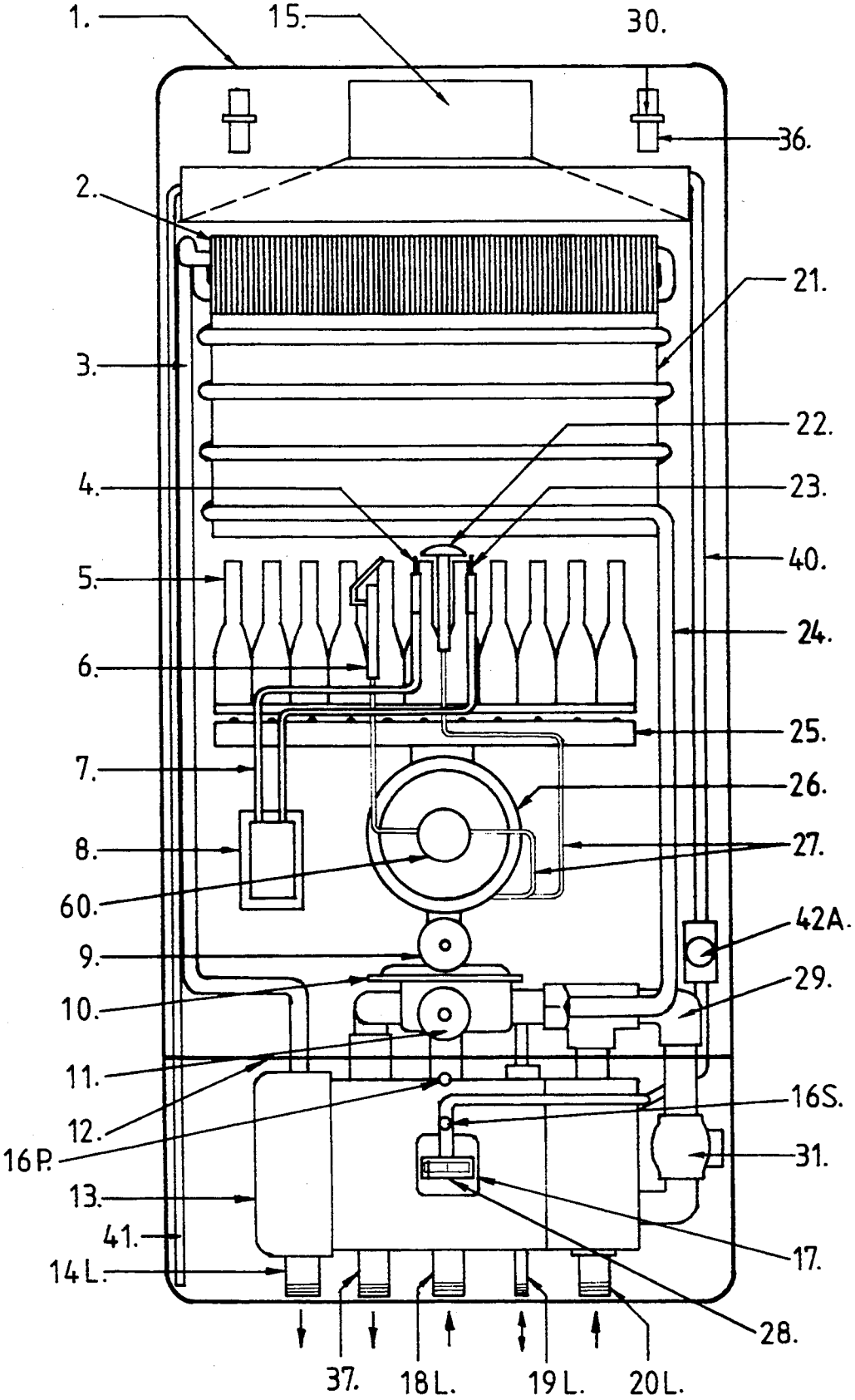
FIG. 2 is a view showing the inner structure of the present invention under a low water pressure supply state.
Figure 3:
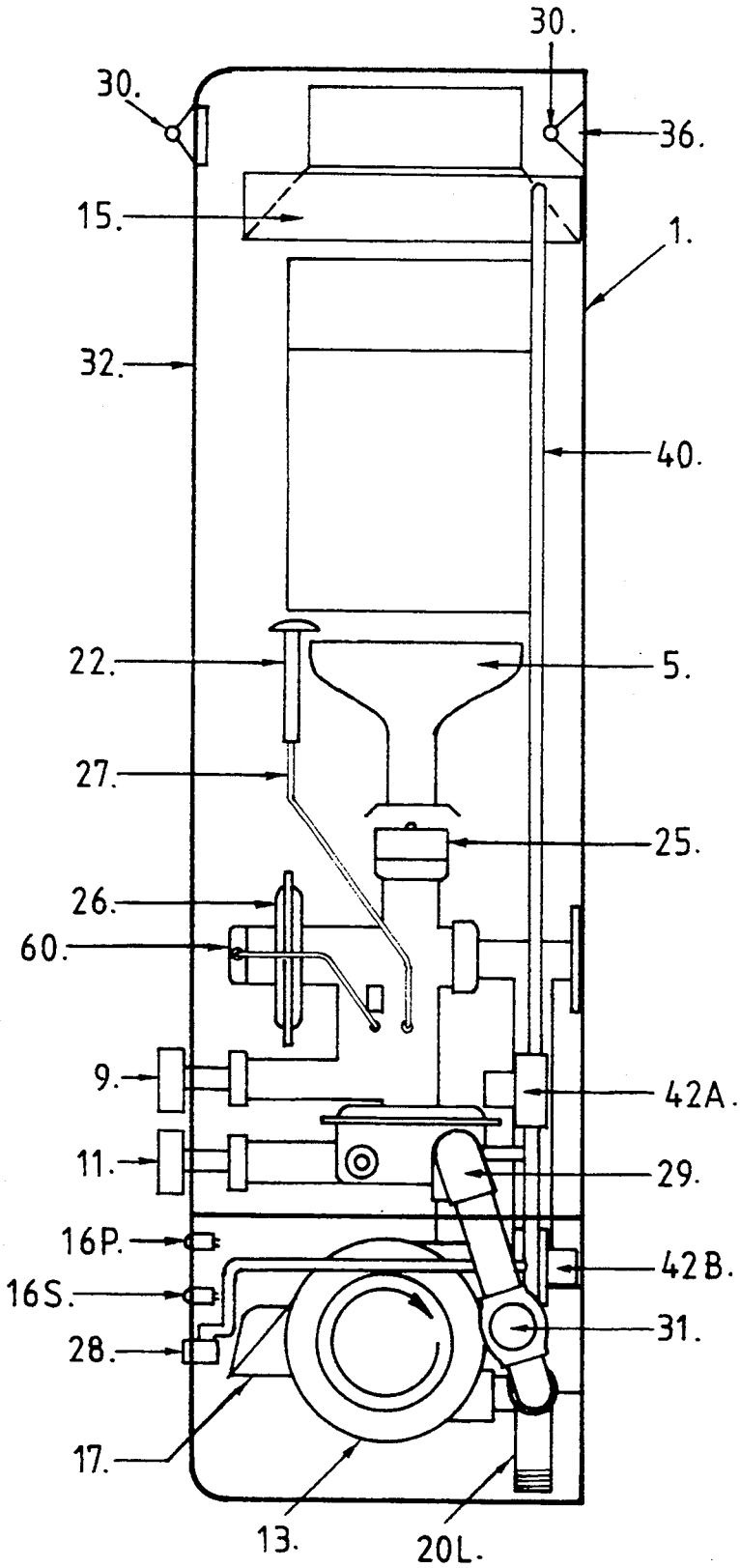
FIG. 3 is a left view according to FIG. 2.
Figure 4:
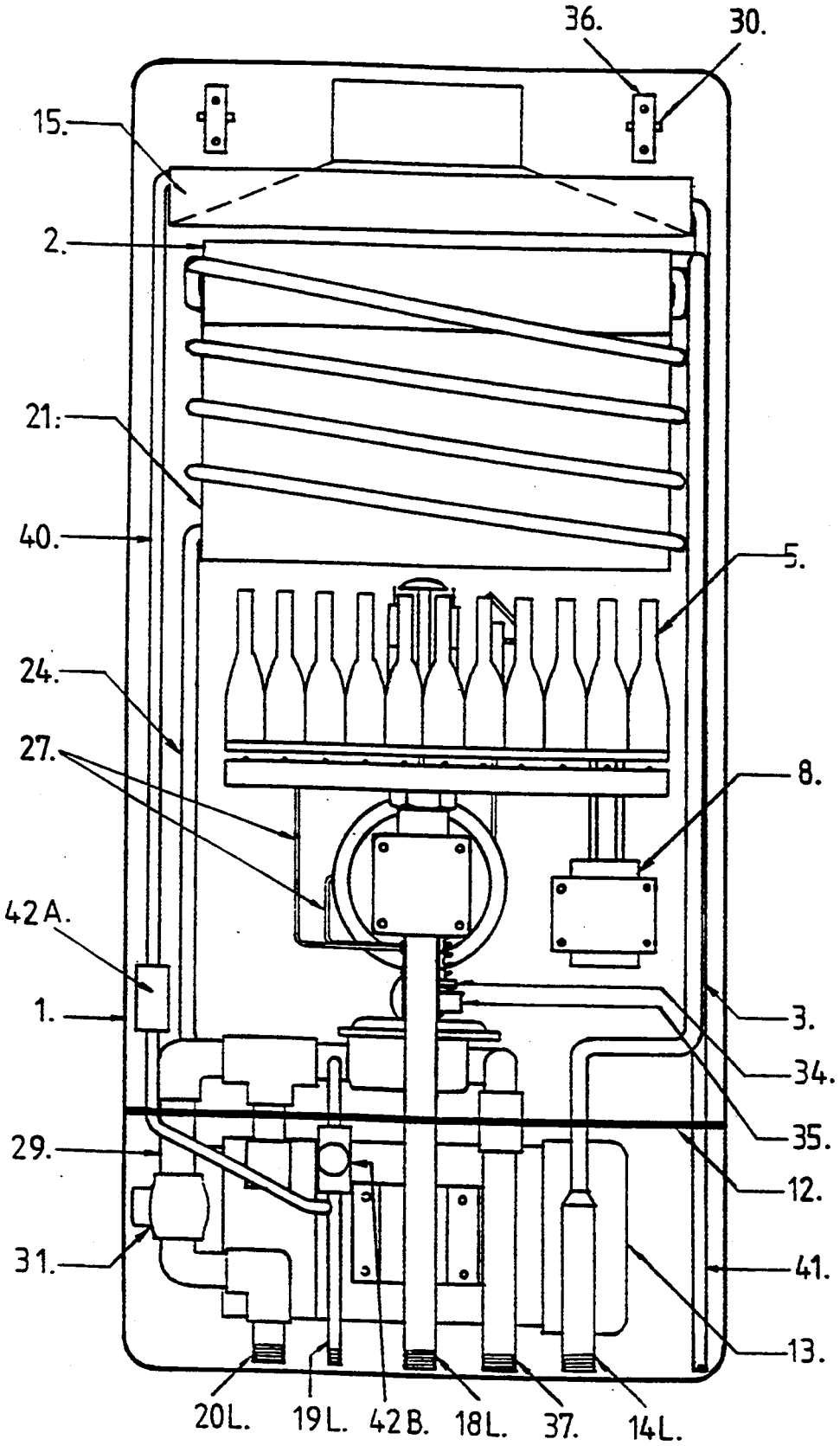
FIG. 4 is a rear view according to FIG. 4.
Figure 5:
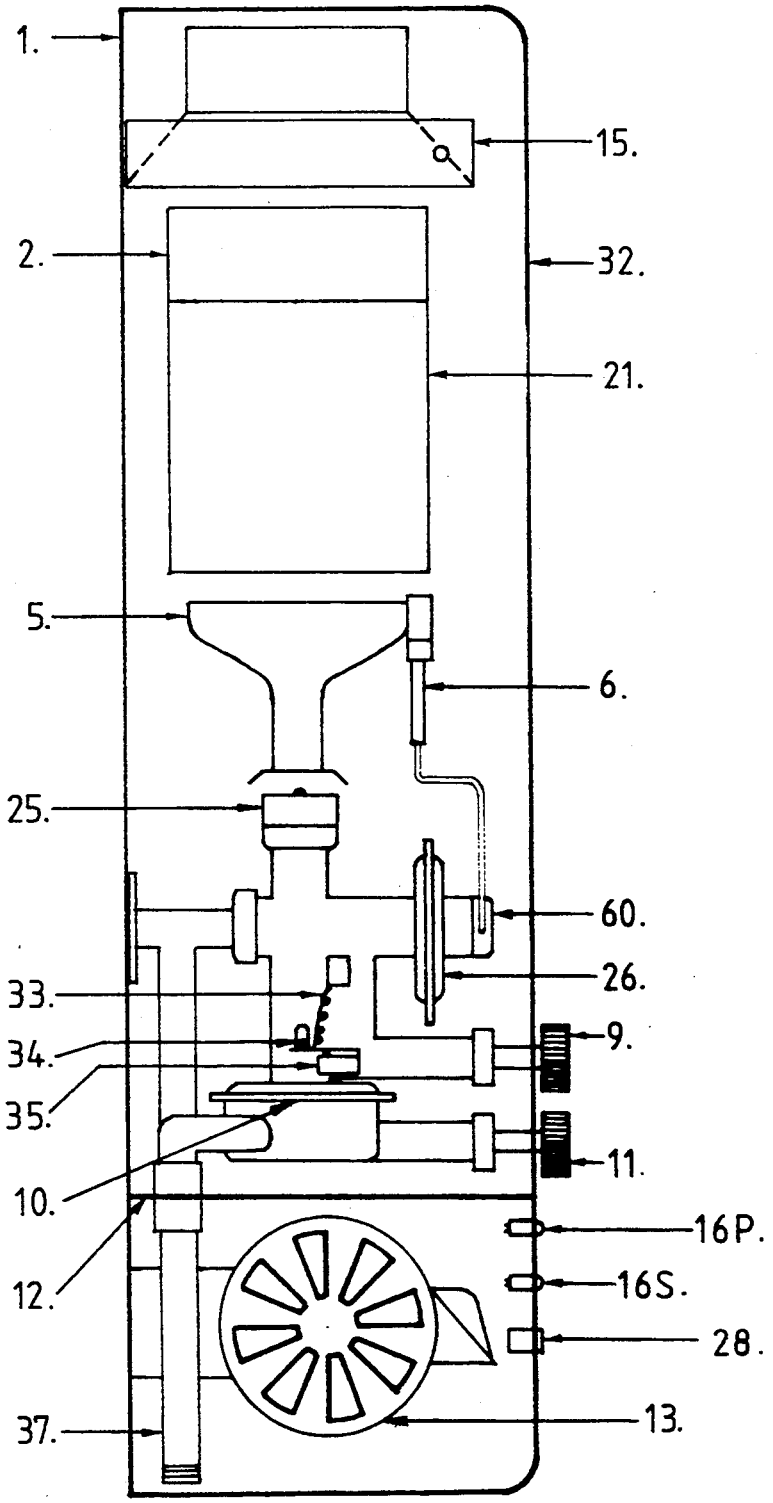
FIG. 5 is a right view according to FIG. 2.
Figure 6:
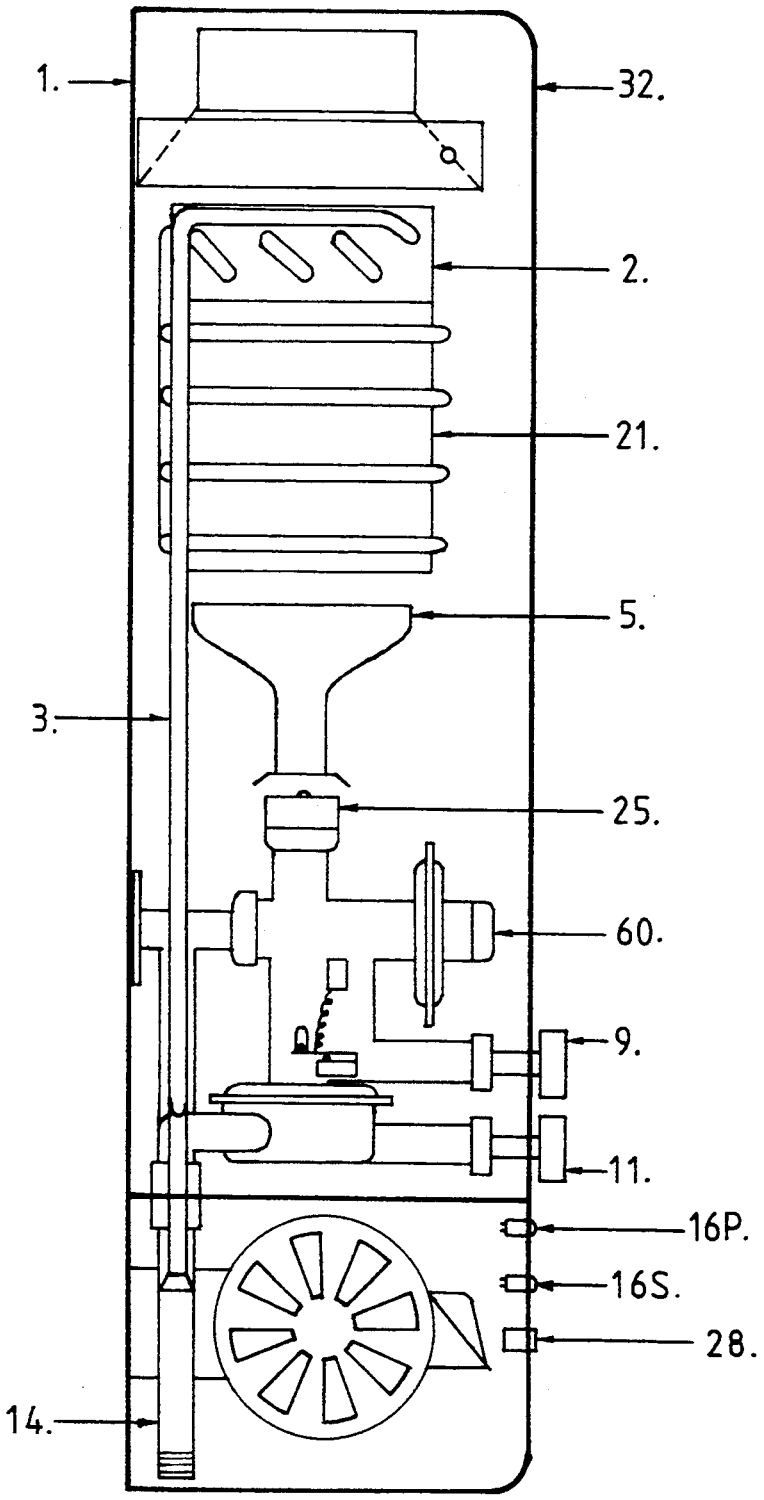
FIG. 6 is a right view according to FIG. 5.
Figure 7:
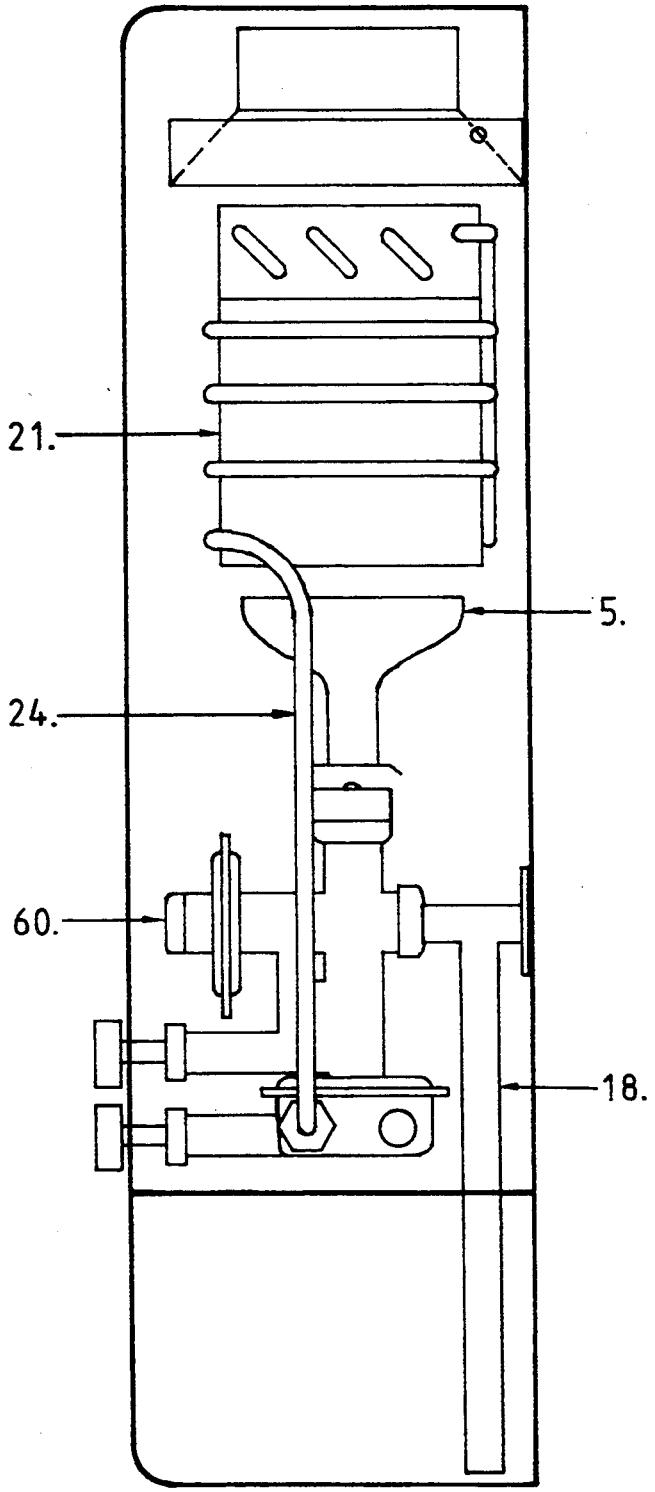
FIG. 7 is a left view according to FIG. 3.
Figure 8A:
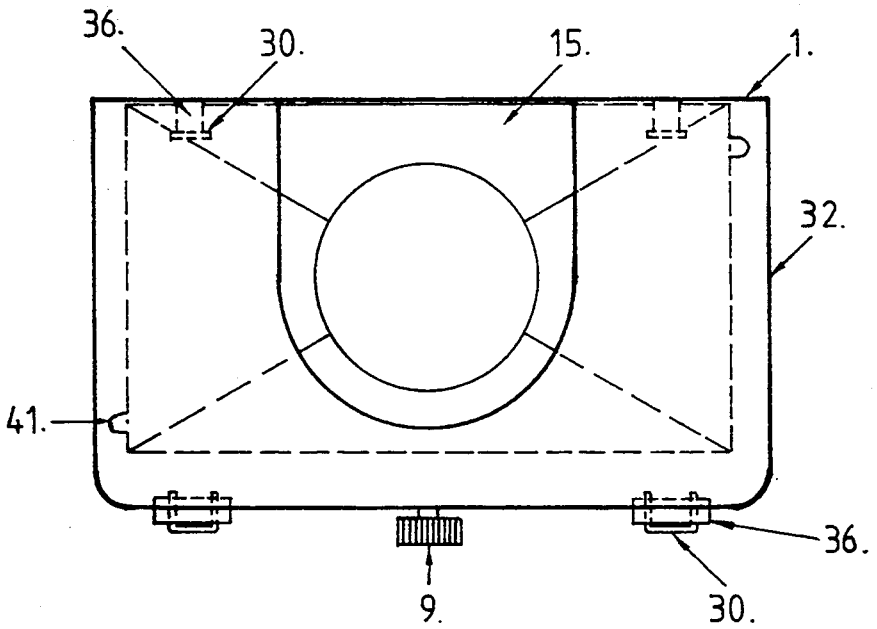
FIG. 8A is a top view according to FIG. 2.
Figure 8B:
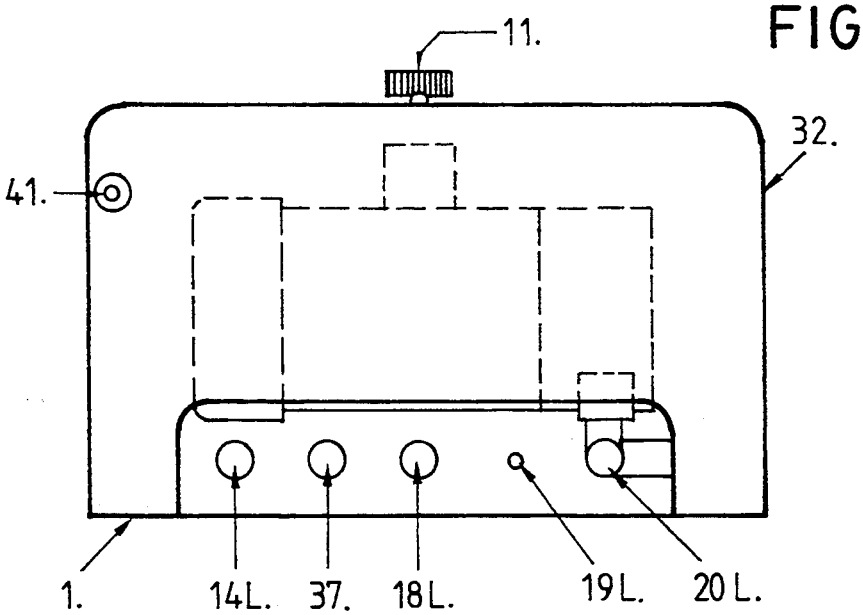
FIG. 8B is a bottom view according to FIG. 2.
Figure 9:
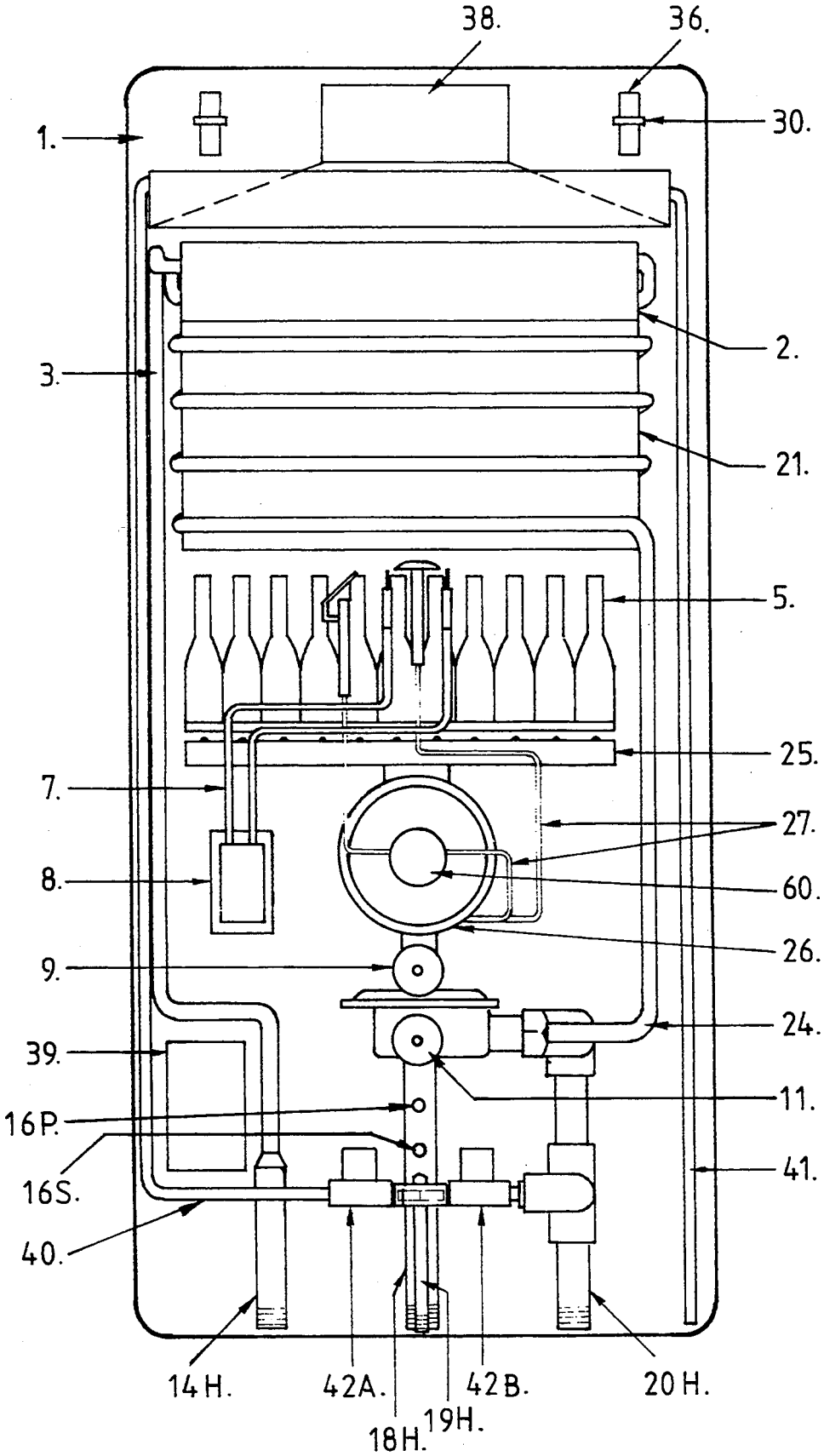
FIG. 9 is a view showing the inner structure of the present invention under a high water pressure supply state.
Figure 10:
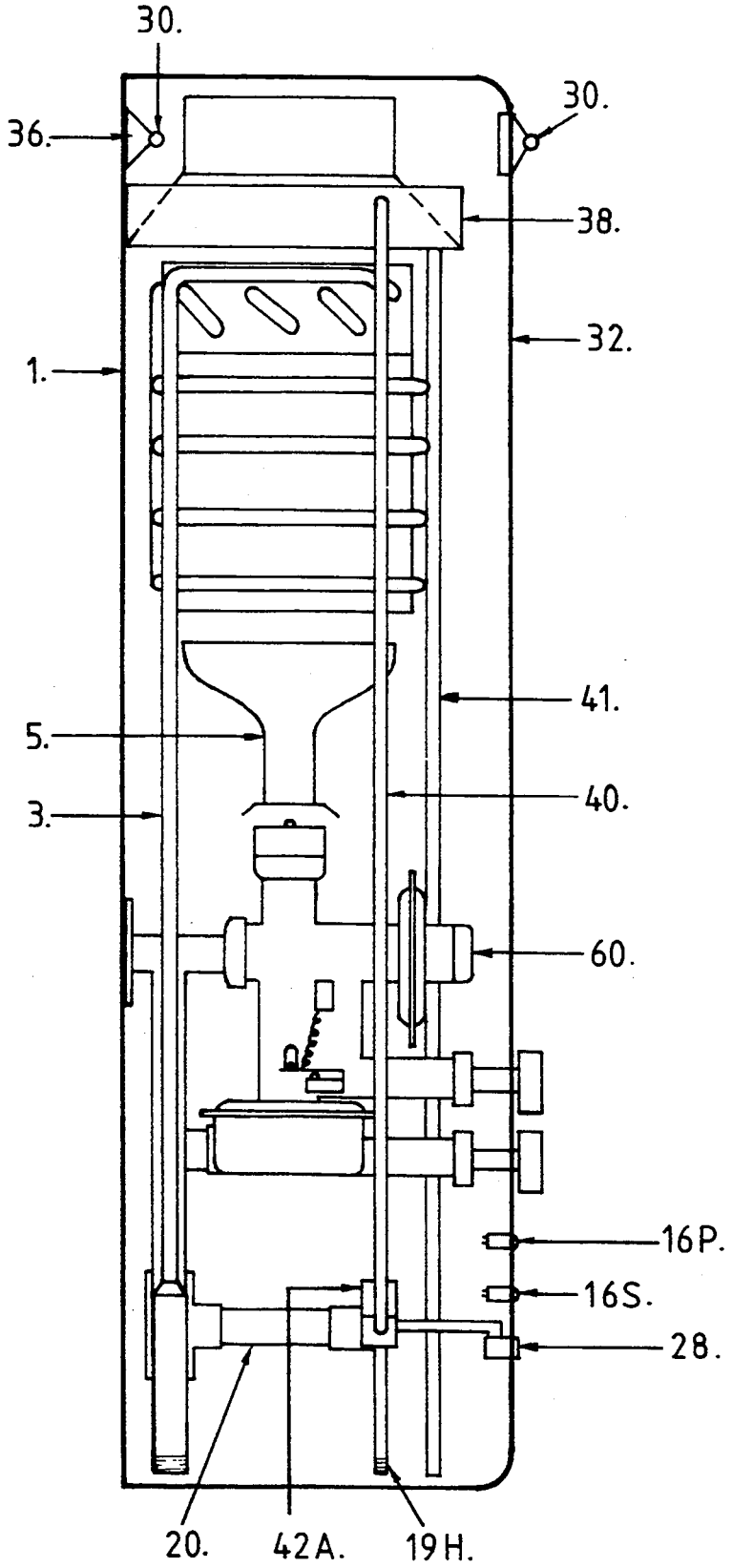
FIG. 10 is a right view according to FIG. 9.
Figure 11:
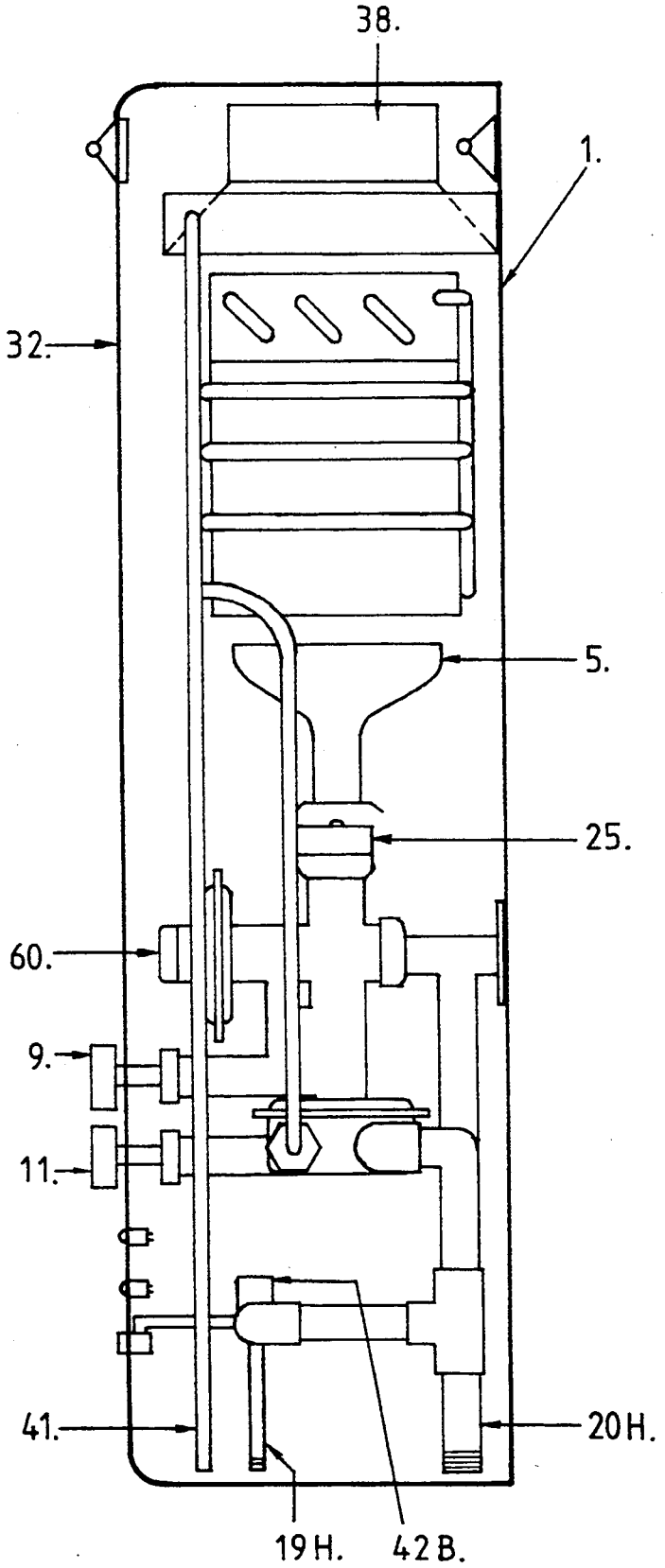
FIG. 11 is a left view according to FIG. 9.
Figure 12A:
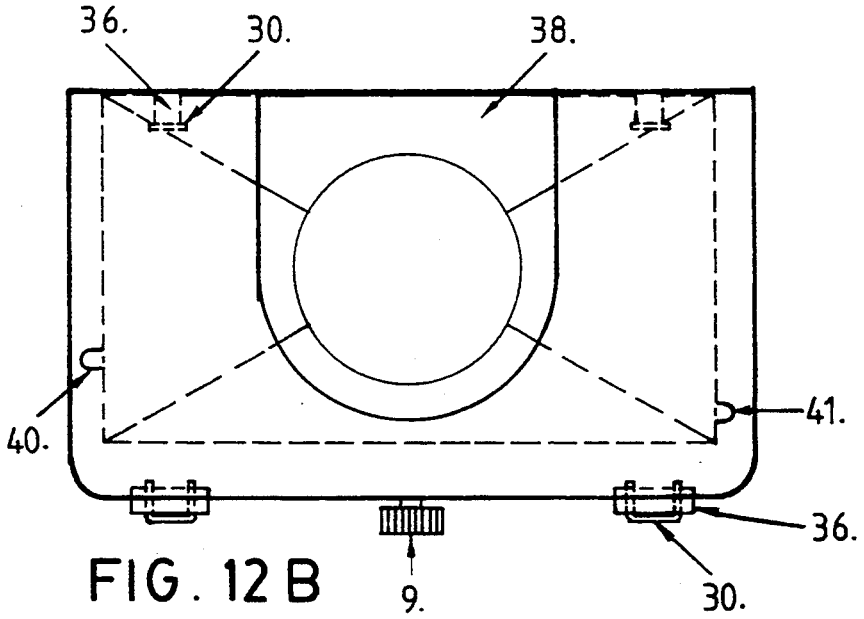
FIG. 12A is a top view according to FIG. 9.
Figure 12B:
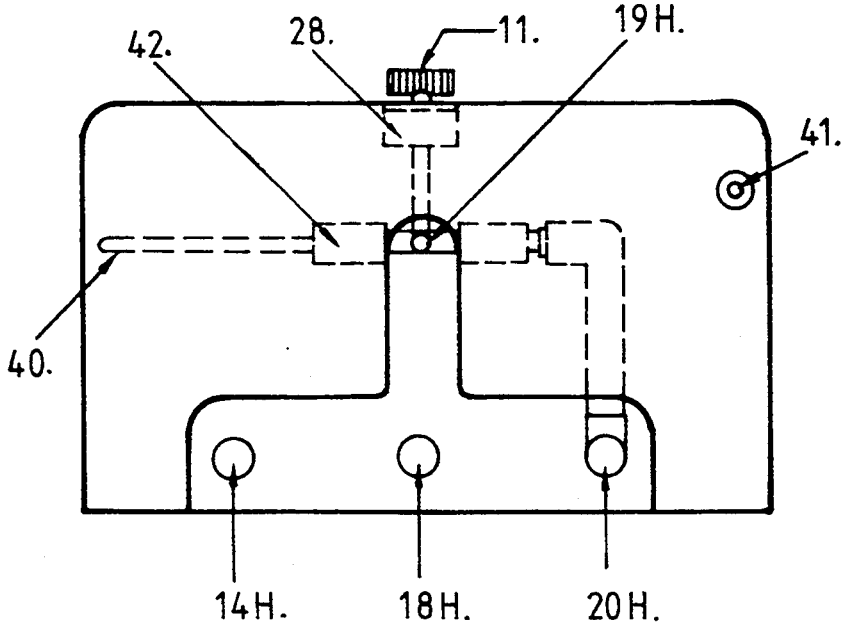
FIG. 12B is a bottom view according to FIG. 9.
Figure 13:
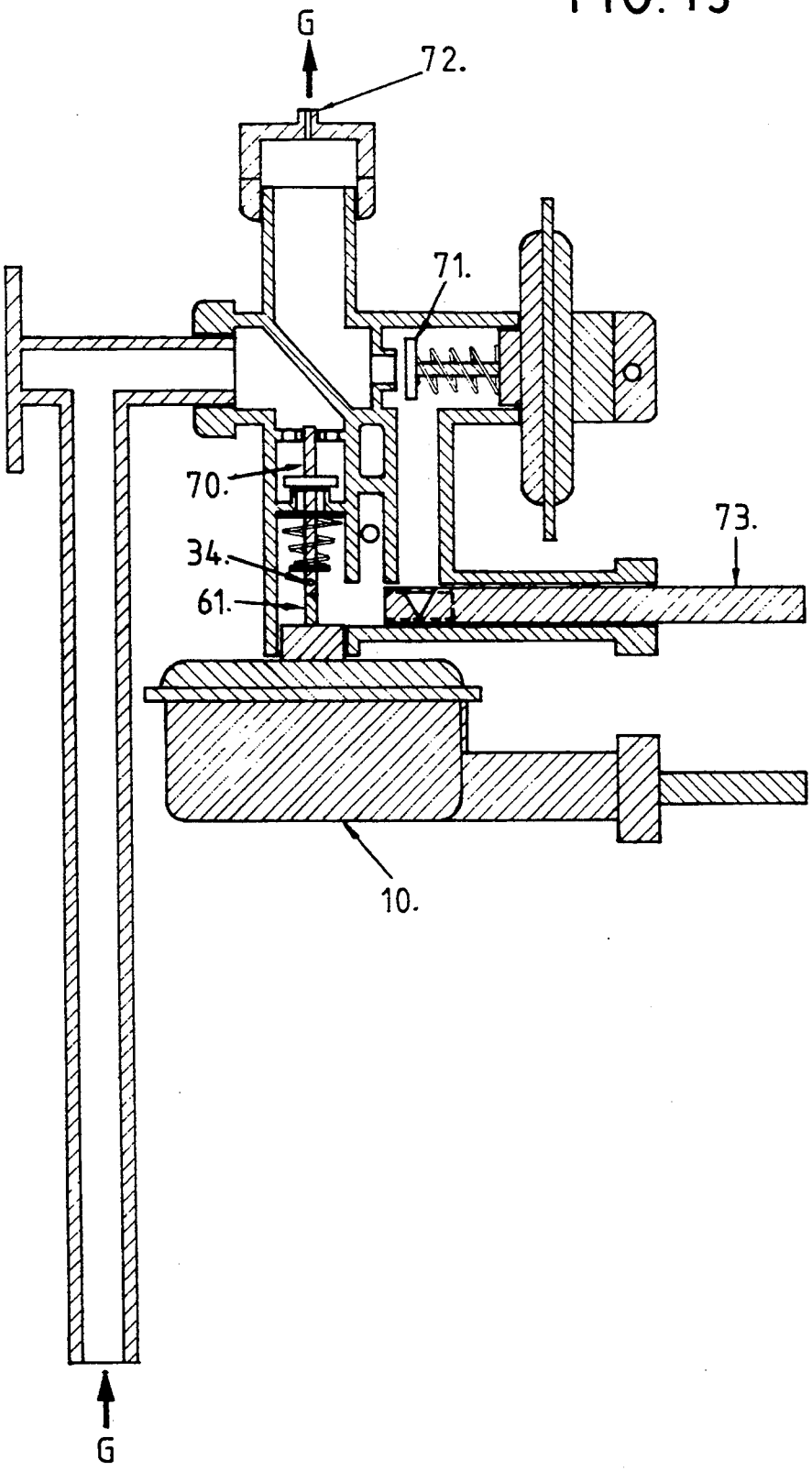
FIG. 13 shows the structure of the gas incoming main and subsidiary valves of the present invention.
Figure 14A:
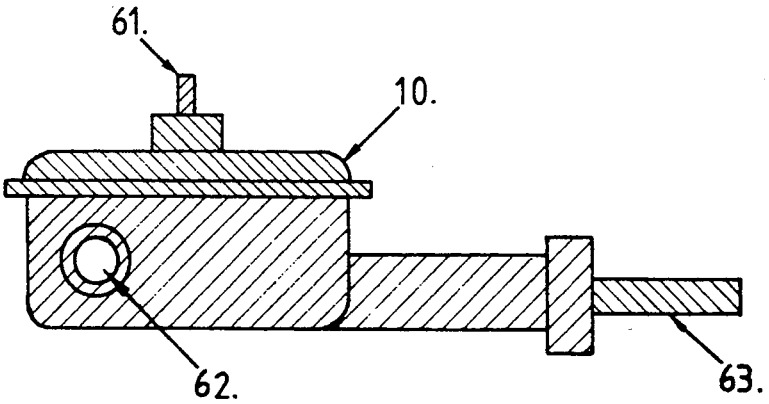
FIGS. 14A–14C show the structure of the Venturi controller.
Figure 14B:
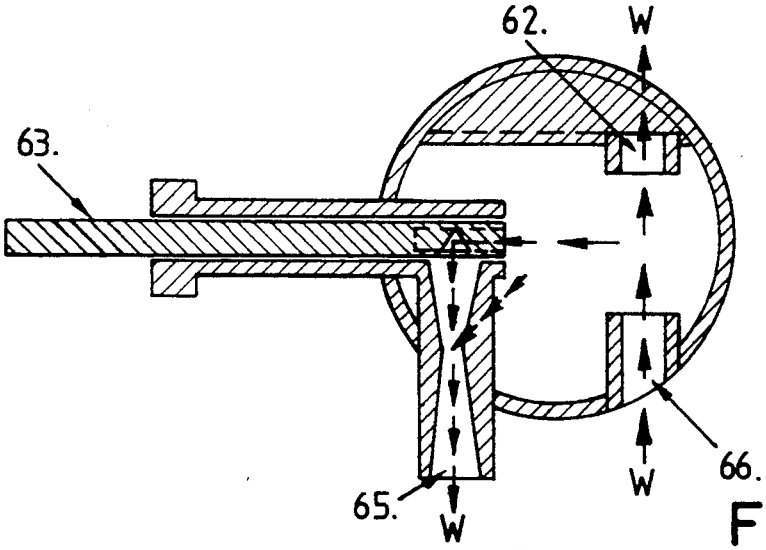
Figure 14C:
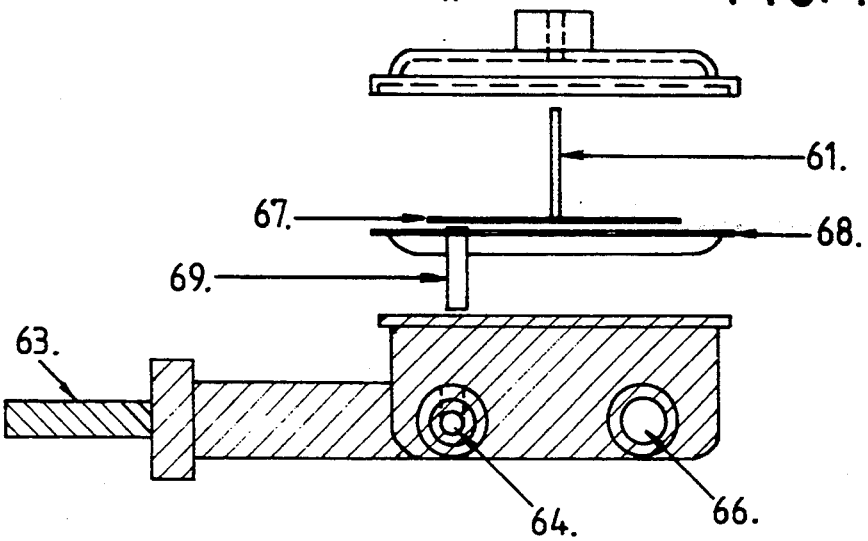
Figure 15A:
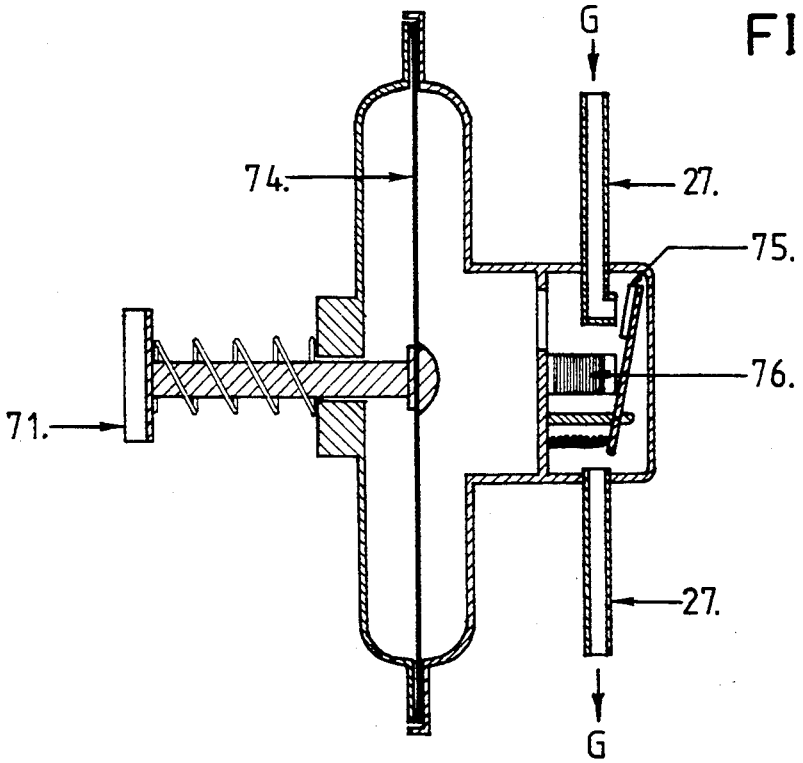
FIGS. 15A and 15B show the structure of the electromagnetic valve of the present invention.
Figure 15B:
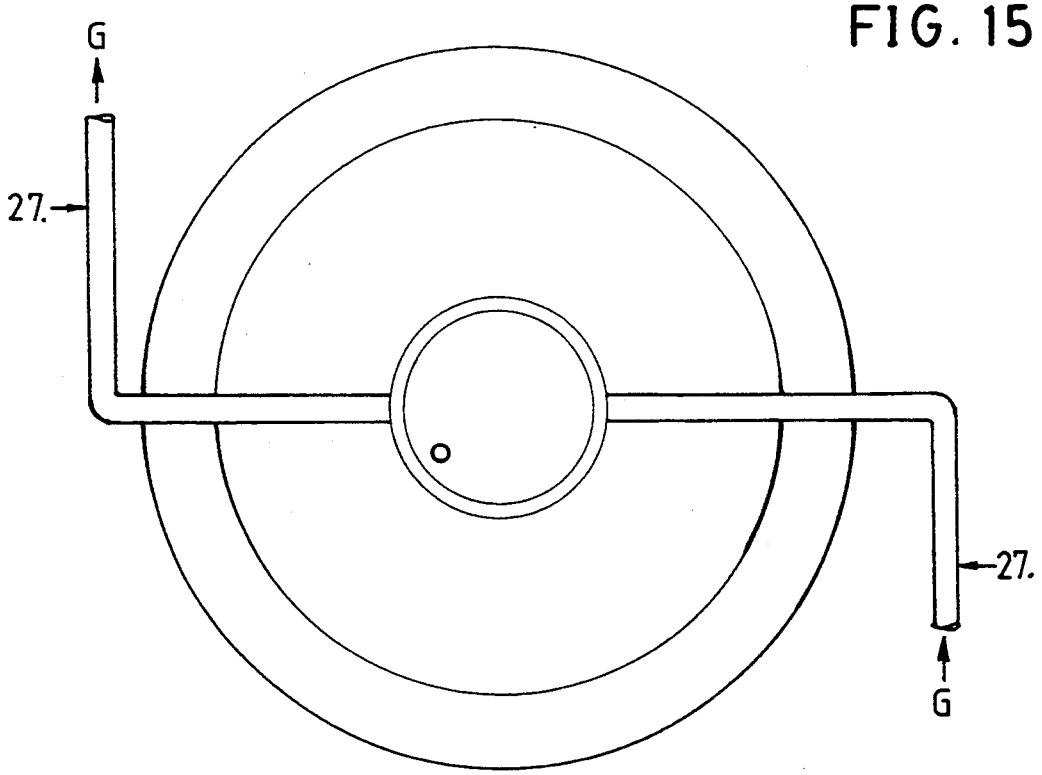
Figure 16A:
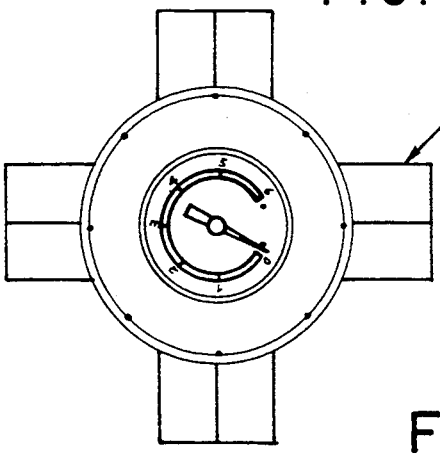
FIGS. 16A–16F show the structure of the water pressure-controlled gas general switch used for natural gas.
Figure 16B:
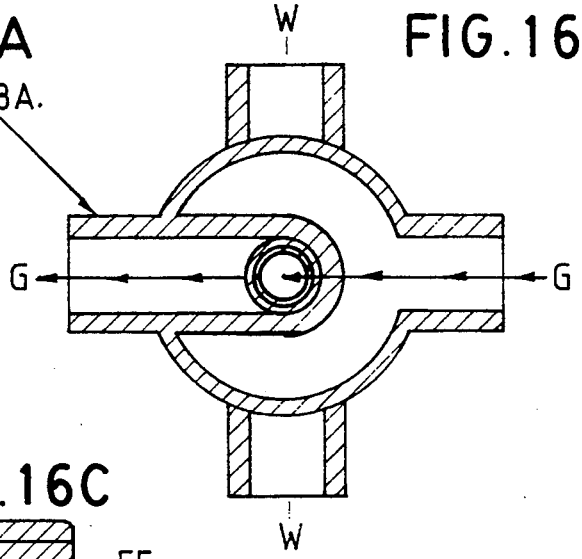
Figure 16C:
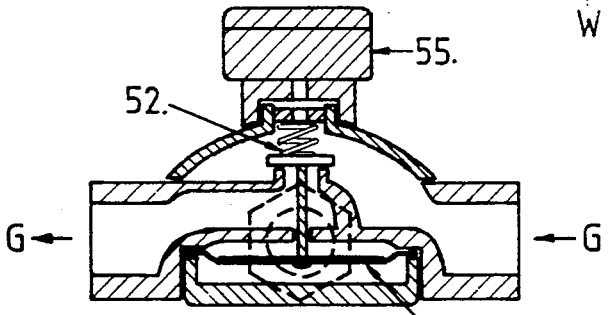
Figure 16D:
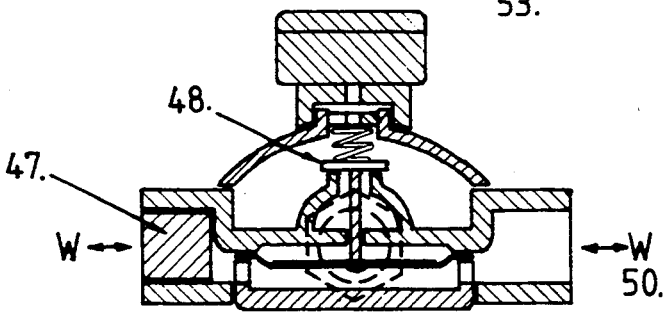
Figure 16E:
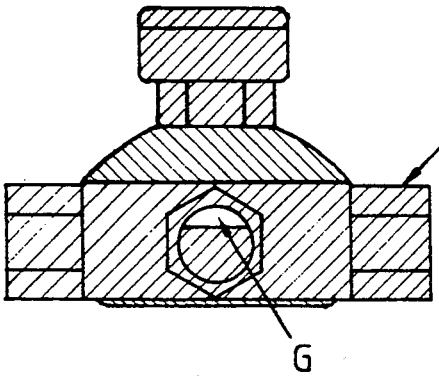
Figure 16F:
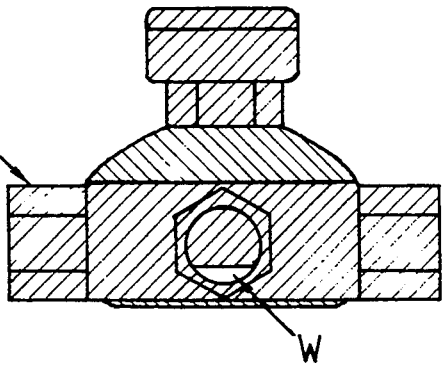
Figure 17A:
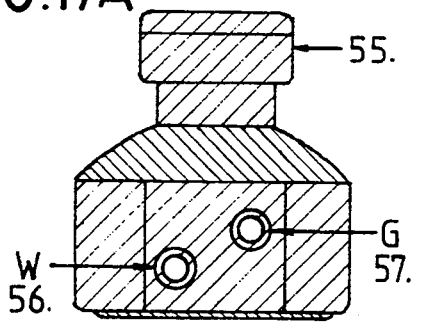
FIGS. 17A–17E show the structure of the water pressure-controlled gas general switch used for liquid gas.
Figure 17B:
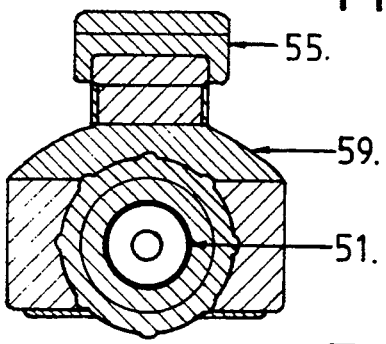
Figure 17C:
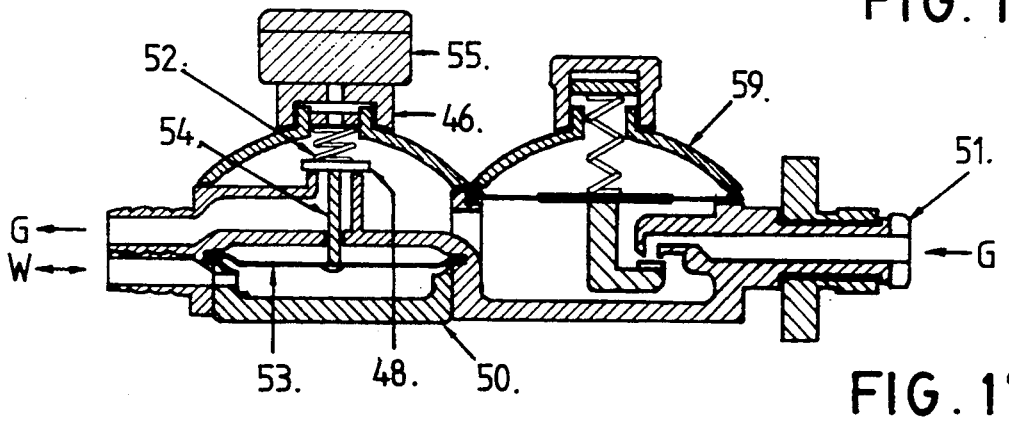
Figure 17D:
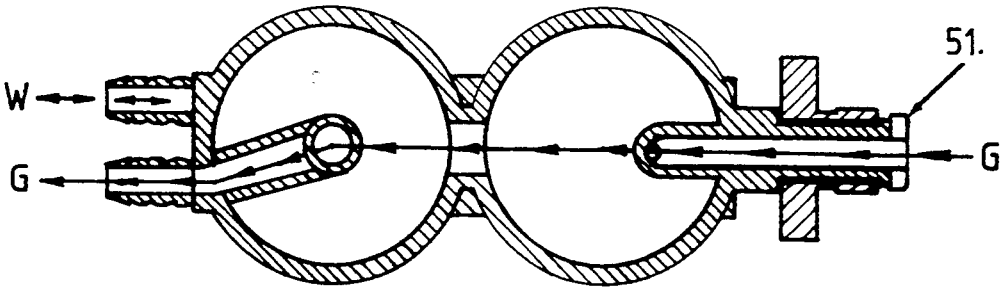
Figure 17E:
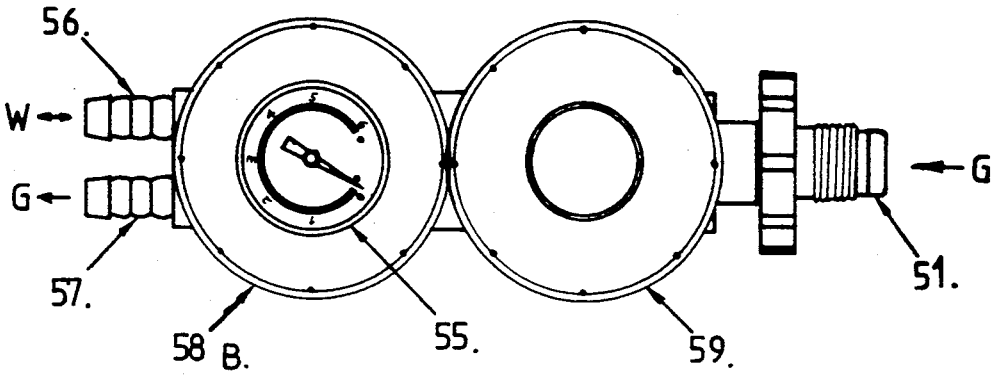

Please refer to FIG. 14. When consuming the hot water, the water enters the Venturi controller 10 from the water supplying pipe 20. It is known that the Venturi controller can connect the electric switch 35 with the power source (as described in the previous paragragh related to the water supplying/discharging system and shown in FIGS. 18 and 19). At this time, both the electromagnetic valves 42A, 42B are supplied with electricity wherein the valve 42A after powered automatically shuts off the water flow while the valve 42B after powered automatically opens, permitting the water to flow into the indicator from the water supplying pipe through the water pressure pipe and water guiding pipe, making the indicating needle of the indicator rotate to an "open" position. The water further flows into the water pressure-controlled gas general switch to turn on the gas.

When stopping consuming hot water, the water stops flowing and the Venturi controller stops working and the power is cut off. At this time, the valves 42A, 42B are disenergized whereby the valve 42B automatically closes to shut off the water while the valve 42A automatically opens. Therefore, the high pressure water in the water guiding pipe and water chamber automatically flows into the low pressure revolving pipe 40 and smoke discharging funnel 15, 38 to be vaporized by the waste heat. When the water pressure disappears, the indicating needle restores to a "close" position and makes the water pressure-controlled gas general switch shut off the gas.

Each switching movement of the gas general switch is automatically controlled by the water flow movement occurring when consuming the hot water. This movement can be seen from the indicator.

The pressurizing motor pump 13 of the present invention can provide greater necessary water amount for a low water pressure supply site. Because the motor pump 13 is integrally manufactured with the water heater in a factory, the design thereof can be more accurate and the site working can be facilitated to save labor, material and time.

As shown in FIGS. 2–6, 8 and 14, when consuming the hot water, the water flows from the water supplying pipe 20L through the check valve 31 and the bypassing pipe 29 into the Venturi controller 10 and flows through the Venturi tube 65 and the cold water outlet 62 in two ways. At this time, the motor pump 13 is still not operated so that the water amount is limited and no hot water is supplied.

Figure 18:
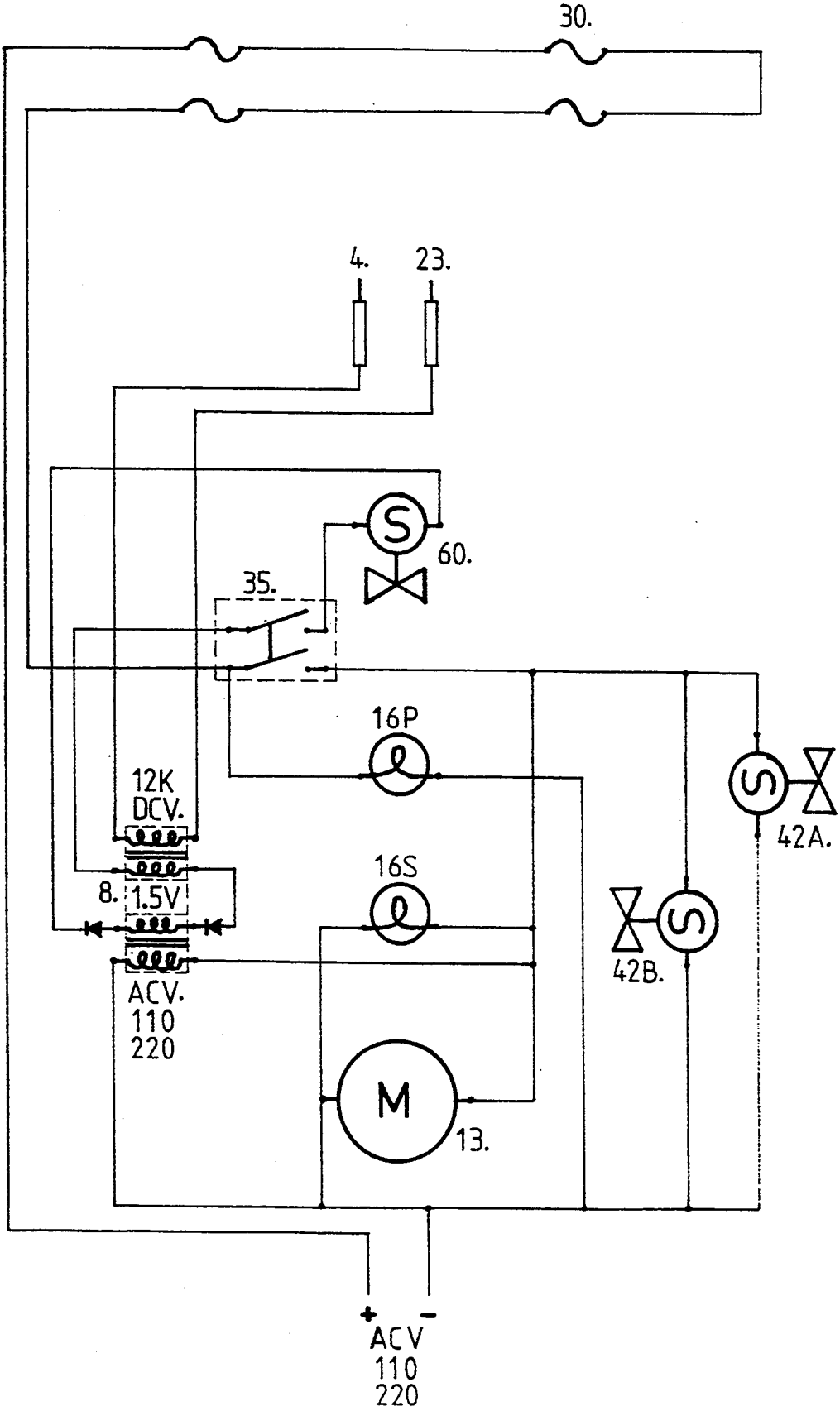
FIG. 18 shows the control circuit of the present invention under a low water pressure supply state.

When the water continuously flows out from the Venturi pipe, the Venturi controller 10 starts to work and connect the power source (as described in the previous paragraph related to the Venturi controller and the electric switch). As shown in FIG. 18, at this time, the pressurizing motor pump 13 is powered to operate, making the water flow jump over the check valve and bypassing pipe and flow directly into the Venturi controller and flow out from the Venturi pipe and cold water outlet in an accelerated and pressurized state. The water finally discharged from the cold water outgoing pipe 37 and the hot water outgoing pipe 14L has the actually needed pressure and larger amount. When stopping consuming the hot water, the Venturi controller cut off the power and the motor pump 13 stops operating.

Figure 19:
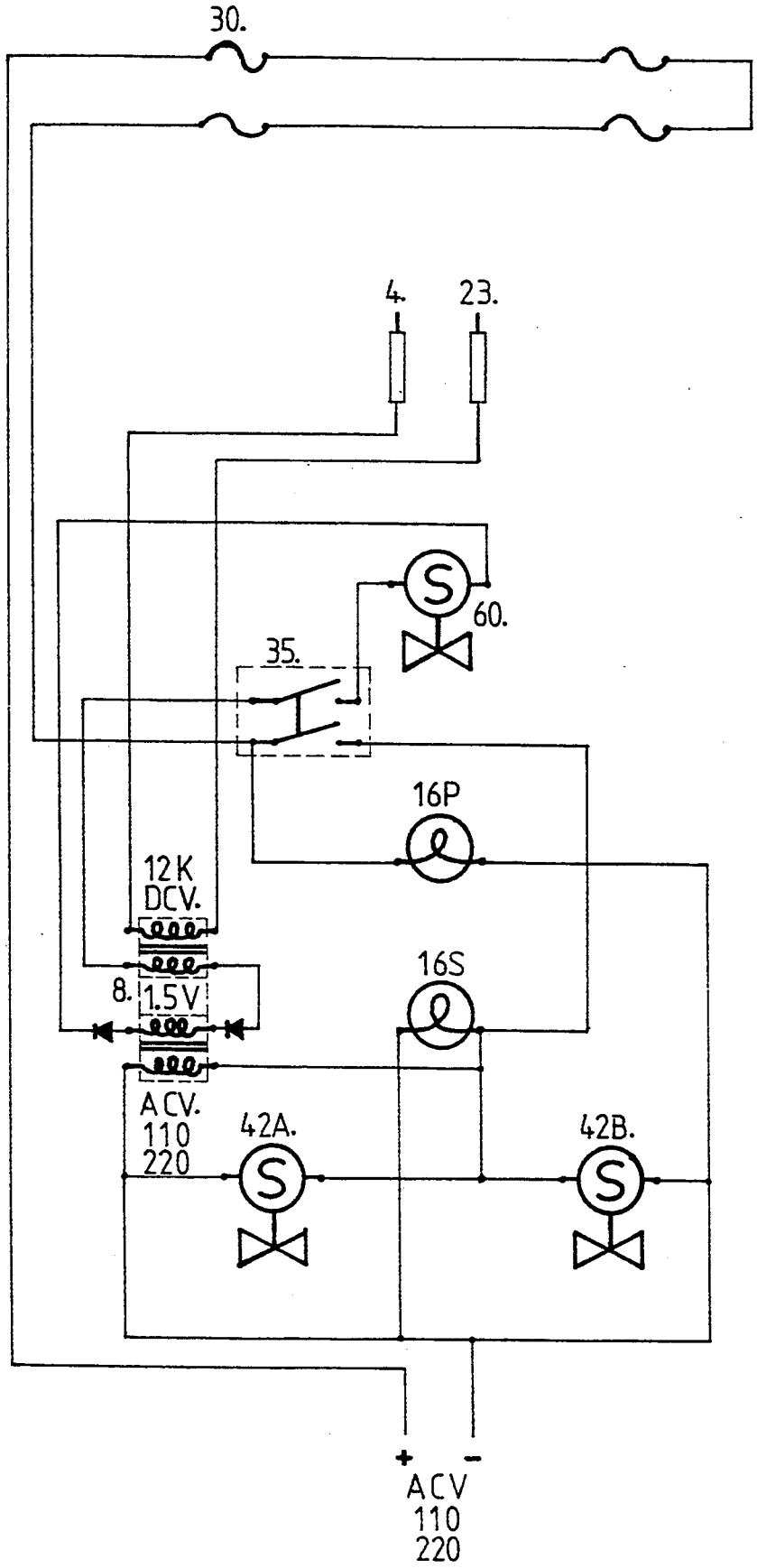
FIG. 19 shows the control circuit of the present invention under a high water pressure supply state.
Figure 20A:
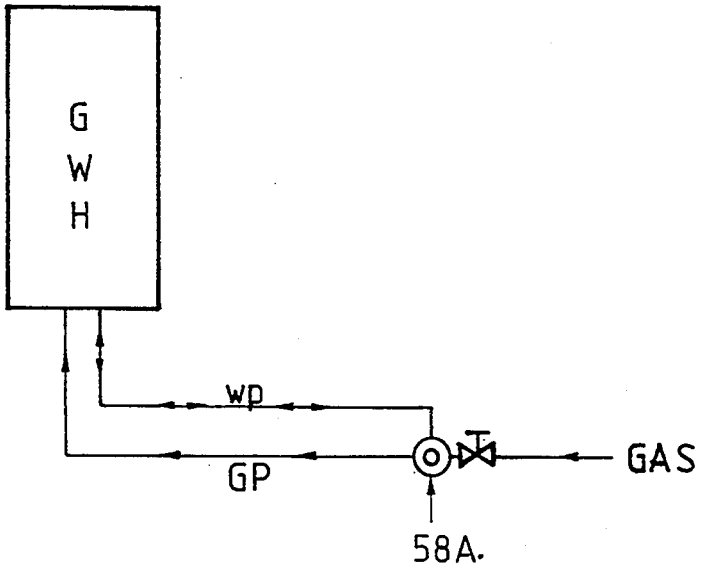
FIG. 20A shows the pipe line of the present invention for natural gas.
Figure 20B:
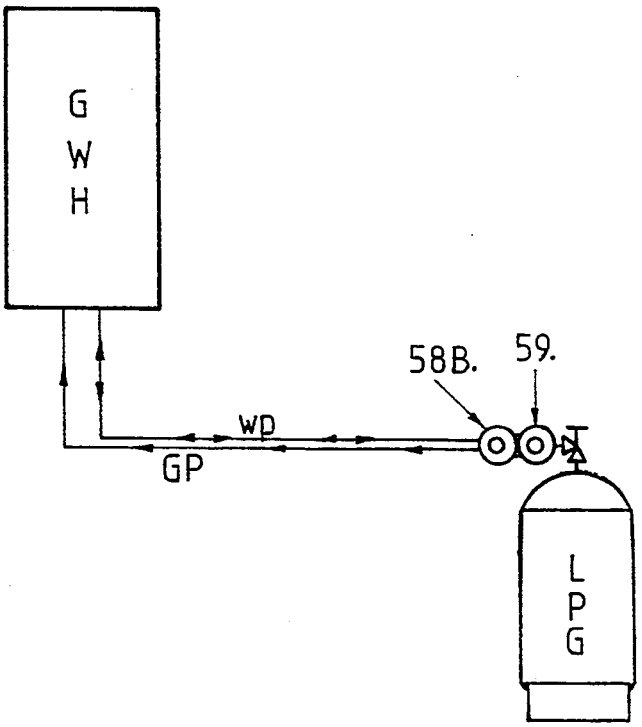
FIG. 20B shows the pipe line of the present invention for liquid gas.

Please refer to FIGS. 1–4 and 8–12. The present invention includes two pairs of fire fuses 30 respectively disposed inside and outside the water heater. The fuses 30 are covered by insulating sleeves and fixed on the water heater by insulating seats 36. The four fuses 30 are connected with the power source wire in series and serve as overload fuses in normal state. In case of a fire, the fuses will be burned down to cut off the power as shown in FIGS. 18 and 19.

When the power is cut, the electric control system stops working. At this time, electromagnetic valve 42B remains close while electromagnetic valve 42A remains open and eliminates the pressure of the water going to the pressure pipe, water guiding pipe and water pressure-controlled gas general switch. At this time, no matter whether the user is consuming hot water, no gas is supplied. Therefore, in case the water heater fails or burns or in case the water heater is burned in a fire, no matter whether the user is consuming hot water, the gas general switch is kept close to shut off the gas so as to avoid aiding the fire.

Because the gas shutting movement of the water pressure-controlled gas general switch is automatically cooperative with the hot water consuming movement, in case the user forgets to turn off the gas general switch, the same can be still turned off. Each movement of the gas general switch can be known via the indicator disposed on the water heater. Moreover, the water pressure-controlled gas general switch is disposed outside the water heater so that the gas general switch can be easily maintained and repaired.

What is claimed is:

1. A gas-using water heater comprising: a water pressure-controlled gas general switch movable between open and closed positions disposed outside the water heater and combined with a manually operated gas general switch into a dual general switch, said water pressure-controlled gas general switch being connected with the water heater by a water guiding pipe to automatically shut off the gas in cooperation with water flowing movements when consuming hot water, wherein an indicator having an indicator needle is disposed on a housing of the water heater for indicating each movement of said gas general switch, the opening and closing operation of said gas general switch being controlled by first and second electromagnetic valves disposed in the water heater, whereby when said second valve is opened, said first valve is closed such that the water flows through said water guiding pipe and a water supplying pipe into said indicator and the water pressure-controlled gas general switch, making the indicating needle of said indicator move to an "open" position and opening said gas general switch, while when said second electromagnetic valve is closed, and said first valve is opened, the water flows through said gas general switch and indicator toward said water guiding pipe making said indicator needle of said indicator move to a "close" position and automatically closing off said gas general switch thereby shutting off the gas.

2. A water heater as claimed in claim 1, further comprising a smoke discharging funnel which discharges waste smoke and means connected to the smoke discharging funnel containing drained water to be vaporized by the heat of the waste smoke.

3. A water heater as claimed in claim 1, further comprising a pressurizing motor pump disposed in the water heater for a low water pressure supply site, and an electric control system to control the running and stopping of said motor pump in accordance with the water flow movement when consuming hot water so as to change the low water pressure supply into high water pressure supply.

4. A water heater as claimed in claim 1, further comprising two pairs of fire fuses a first pair disposed inside and a second pair disposed outside the water heater, said fuses being connected with an electric control system whereby in case the water heater fails or burns in a fire, said fuses will be burned down, cutting off the power to said first and second electromagnetic valves to cause said gas general switch to automatically shut off the gas and keep the gas general switch in a closed state to avoid aiding the fire.

5. A water heater as claimed in claim 1, wherein said gas general switch is suitable for natural gas and liquid gas, wherein respecting the liquid gas, said gas general switch further comprises: means disposed on a top portion of said gas general switch for indicating the remaining gas, said gas general switch being divided into upper and lower chambers, wherein the upper chamber is a first water chamber while the lower chamber is a second water chamber which is separated from the upper chamber by a resilient separating board;

a link rod and an airtight board disposed on said resilient separating board;

a spring disposed on said airtight board, whereby when said lower chamber is free from water pressure, said airtight board seals a gas inlet, preventing the gas from passing therethrough, while when said lower chamber has water pressure, said separating board is displaced upward to move said airtight board away from the gas inlet, permitting the gas to pass therethrough.

* * * * *